US006705409B2

(12) United States Patent
Paul

(10) Patent No.: US 6,705,409 B2
(45) Date of Patent: Mar. 16, 2004

(54) RECIPROCATING TOOL HAVING A PISTON RETAINING SYSTEM

(75) Inventor: Pradip Kumar Paul, Charlotte, NC (US)

(73) Assignee: Chicago Pneumatic Tool Company, Rock Hill, SC (US)

( * ) Notice: Subject to any disclaimer, the term of this patent is extended or adjusted under 35 U.S.C. 154(b) by 159 days.

(21) Appl. No.: 09/941,324

(22) Filed: Aug. 30, 2001

(65) Prior Publication Data

US 2002/0134562 A1 Sep. 26, 2002

Related U.S. Application Data

(63) Continuation-in-part of application No. 09/815,354, filed on Mar. 22, 2001, now abandoned.

(51) Int. Cl.[7] ..... B25C 9/02

(52) U.S. Cl. ..... 173/132; 173/128; 173/210; 173/139; 279/19.1

(58) Field of Search ..... 173/17, 132, 128, 173/210, 211, 139; 277/124, 216, 217, 233; 227/10; 279/102, 19.1, 19.2, 19.4

(56) References Cited

U.S. PATENT DOCUMENTS

| | | | | |
|---|---|---|---|---|
| 2,512,149 A | * | 6/1950 | Gartin | 279/19.5 |
| 4,133,394 A | * | 1/1979 | Wohlwend | 173/139 |
| 4,358,041 A | | 11/1982 | Ollivier | |
| 5,145,265 A | * | 9/1992 | Flem | 384/296 |
| 5,884,828 A | | 3/1999 | Hirtl et al. | |
| 5,896,934 A | | 4/1999 | Yaniero et al. | |
| 5,901,894 A | | 5/1999 | Melocco | |
| 5,944,120 A | * | 8/1999 | Barden | 173/138 |
| 6,085,958 A | | 7/2000 | Kersten | |
| 6,098,723 A | | 8/2000 | Yaniero et al. | |
| 6,123,242 A | | 9/2000 | Kersten | |
| 6,123,243 A | | 9/2000 | Pfister et al. | |

* cited by examiner

*Primary Examiner*—Scott A. Smith
(74) *Attorney, Agent, or Firm*—Schmeiser, Olsen & Watts

(57) ABSTRACT

Disclosed is a reciprocating pneumatic tool including first, second and third piston retaining mechanisms for preventing the piston from freely exiting the barrel of the tool when the retaining sleeve and workpiece are removed. The retaining mechanisms are located within the lower portion of the tool barrel, and do not interfere with normal operation of the tool.

45 Claims, 4 Drawing Sheets

RECIPROCATING TOOL HAVING A PISTON RETAINING SYSTEM

This application is a continuation-in-part of U.S. patent application Ser. No. 09/815,354, filed on Mar. 22, 2001, now abandoned.

BACKGROUND OF THE INVENTION

1. Field of the Invention

The present invention relates to reciprocating power tools, and more particularly, to a piston retaining system in the barrel of a pneumatic tool.

2. Description of the Prior Art

Reciprocating power tools that hammer, chisel, and drill have been utilized in the construction industry for years, and will likely continue to play an important role on most job sites in the future. Pneumatically driven reciprocating tools have proven to be particularly effective in delivering high performance for relatively low cost. While ongoing design improvements have enhanced certain functional aspects of such tools, the basic design concept of a reciprocating pneumatic tool has not changed.

An example of such a tool is the Chicago Pneumatic™ 4181™ "Rivet Buster." Like most similar pneumatically driven tools, the 4181 includes an elongated barrel with a handle and trigger at one end and a retaining sleeve at the other end for holding a workpiece (e.g., a chisel or the like). Inside an upper portion of the barrel, proximate the handle, is a piston that reciprocates back and forth within the barrel, repeatedly striking the butt end of the workpiece within the lower portion of the barrel, thereby causing the workpiece head to reciprocate outside of the barrel.

As noted above, such tools include a retaining sleeve, which may be removed to perform routine maintenance on the tool or to remove or replace the workpiece. In tool designs like the 4181, once the sleeve, workpiece and collars are removed, the piston can, under certain conditions, freely escape from the barrel. This feature promotes easy removal of the piston which may be desirable for maintenance purposes. Moreover, as long as the user takes basic precautionary steps, such as disengaging the tool from the air supply before removing the sleeve, the design presents no problem. However, if the worker fails to take such precautions, the piston could inadvertently exit the barrel. For example, if the sleeve is removed and the trigger is pressed while the tool is operable, the piston could be ejected from the barrel with a fair amount of force, causing damage.

Thus, a need exists to provide a system that will prevent the free escape of the piston from the barrel when the retainer sleeve is removed. In addition, the system should not interfere with the existing functionality of the tool.

SUMMARY OF THE INVENTION

In order to overcome the limitations of the prior art, the present invention provides a piston retaining system for preventing the free escape of the piston from the barrel of a reciprocating tool when the retaining sleeve and workpiece are removed. The improved tool comprises a barrel, a piston slidably placed within an upper portion of the barrel, a retaining sleeve mounted proximate a lower portion of the barrel, a workpiece slidably retained within the lower portion of the barrel by the retaining sleeve, and a piston retaining system including at least a first, a second and a third piston retaining mechanism, for preventing the free escape of the piston from the barrel when the retaining sleeve and workpiece are removed. The retaining mechanisms are mounted within the lower portion of the barrel in such a manner that neither the piston nor the workpiece contacts the retaining mechanisms during the actual operation of the tool.

The first piston retaining mechanism may comprise a retainer ring placeable within a circular groove cut into the inside diameter of the barrel. Specifically, the retainer ring is distally mounted around the butt of the workpiece. The retainer ring includes an opening with a diameter greater than the diameter of the butt of the workpiece, and slightly smaller than the first end of a stepped piston, and significantly less than the largest diameter of the piston. Therefore, the tool can operate without interference from the ring, yet the ring acts as a brake when engaged by the lower portion of the piston, and further, prevents the piston from exiting the barrel when the retaining sleeve and workpiece are removed. The ring may include a tapered inner surface to help trap the piston if required. The ring may be made of strong, yet flexible material, with a scarf cut so that it can be removed from the barrel and replaced if necessary.

The second piston retaining mechanism may include a restricted area formed within the lower end of the barrel. The restricted area has a diameter greater than the diameter of the butt of the workpiece and the first stepped end of the piston, but less than the largest diameter of the piston. The restricted area prevents the inadvertent escape of the piston in the event the ring is worn, removed or in some other manner malfunctions while the retaining sleeve and workpiece are removed.

The third piston retaining mechanism may include an annular ring located within the lower end of the barrel, beyond the location of the second piston retaining mechanism. The annular ring has a diameter greater than the diameter of the butt of the workpiece slightly smaller than the first stepped end of the piston, but less than the largest diameter of the piston. The annular ring prevents the impact of piston on the restricted area of barrel and prevents inadvertent escape of the piston in the event the ring and the restricted area fail.

It is therefore an object of the present invention to provide a piston retaining system that will prevent the free escape of the piston from the barrel of a reciprocal tool when the retaining sleeve and workpiece are removed and the lever is activated inadvertently.

It is therefore a further object of the present invention to provide piston retaining systems that will not interfere with, or contact, the piston or workpiece during normal operation of the tool.

DESCRIPTION OF THE PREFERRED EMBODIMENT

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc. Although the drawings are intended to illustrate the present invention, the drawings are not necessarily drawn to scale.

Figure 1:
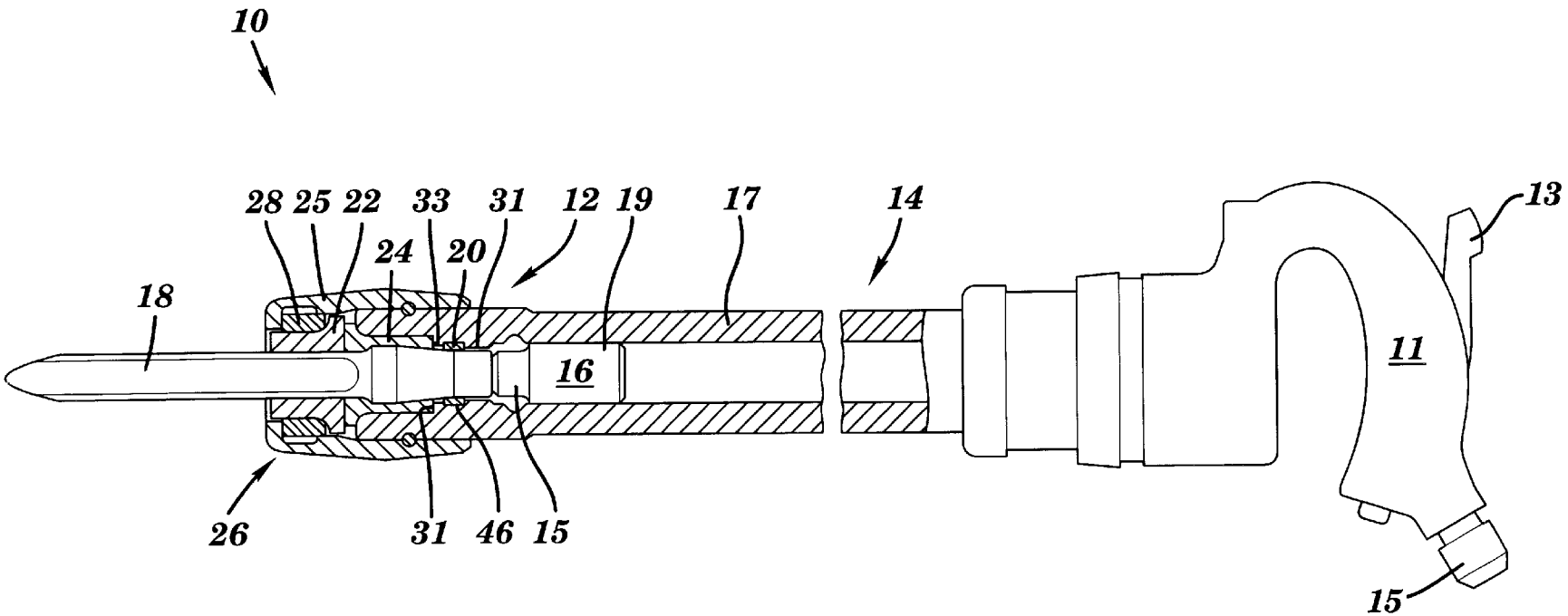
FIG. 1 depicts a cross-sectional side view of a pneumatic tool that includes a piston retaining system in accordance with the present invention.

Referring to the drawings, FIG. 1 depicts a side view of a pneumatic tool 10 that includes a piston retaining system in accordance with the present invention. The tool 10 generally comprises a handle 11, a barrel 17, a retaining sleeve 26, and a workpiece 18. The handle 11 includes an air intake port 9 and a trigger 13. To generally operate the tool 10, pneumatic air is supplied into the air intake port 9. Pressing the trigger 13 then causes the workpiece 18 to reciprocate thereby causing a hammering, chiseling or drilling motion.

The barrel 17 includes a proximal portion 14 and a distal portion 12. During operation, a piston 16 reciprocates within the proximal portion 14 of the barrel 17 and repeatedly strikes a first end 30 of the workpiece 18 causing the workpiece 18 to reciprocate within the distal portion 12 of the barrel 17. The piston 16 is generally cylindrical at an upper end or portion 19 having a stepped or tapered lower end or portion 15. The piston 16 has a maximum diameter at the upper end 19, which is approximately equal to the inner diameter of the proximal portion 14 of the barrel 17. The piston 16 has a stepped decreased diameter at the lower end 15.

The retaining sleeve 26 slidably retains the workpiece 18 in place such that a second end of the work piece 18 (e.g., a chisel head) can extend and reciprocate outside of the tool 10. The second end of the workpiece 18 may include a chisel, drill, hammer, or any other commonly used tool. As noted, the retaining sleeve 26 provides a system for allowing the workpiece 18 to slidably move within the distal portion 12 of the barrel 17 during operation of the tool 10. In addition, the retaining sleeve 26 can be removed from the tool 10 in order to remove and replace the workpiece 18 when the tool 10 is not in operation.

The retaining sleeve 26 includes an outer sleeve 25, a first inner sleeve 24, a second inner sleeve 22 and a bumper 28 The first inner sleeve 24 and the second inner sleeve 22 hold and lock onto the workpiece 18 and are slidable within the retainer sleeve 26. The motion of workpiece 18 is limited by the longitudinal space within which the first inner sleeve 24 and the second inner sleeve 22 can travel. In particular, the inner sleeves 22, 24 are limited in a first direction by the end of distal portion 12 of the barrel 17 and are limited in a second direction by the outer sleeve 25 and the bumper 28 which also acts as a spring for returning the work piece 18 to a neutral position.

The tool 10 further includes a piston retaining system, which may be made up of a first 20, a second 31 and a third 33 piston retaining mechanism. The first piston retaining mechanism 20, in this example a retainer ring, prevents the piston 16 from escaping the distal portion 12 of the barrel 17 when the retaining sleeve 26 and the workpiece 18 are removed from the tool 10. As is discussed with respect to FIGS. 2–4, the retainer ring 20 does not interfere with the piston 16 or the workpiece 18 while the tool 10 is being operated.

While this embodiment generally describes the first piston retaining mechanism as a ring, it is understood that any device that is similarly situated to provide the same functionality falls within the scope of this invention. For example, a star shaped ring, a semi-circular ring, a nub shaped protrusion, or similar device could likewise be used.

Figure 2:
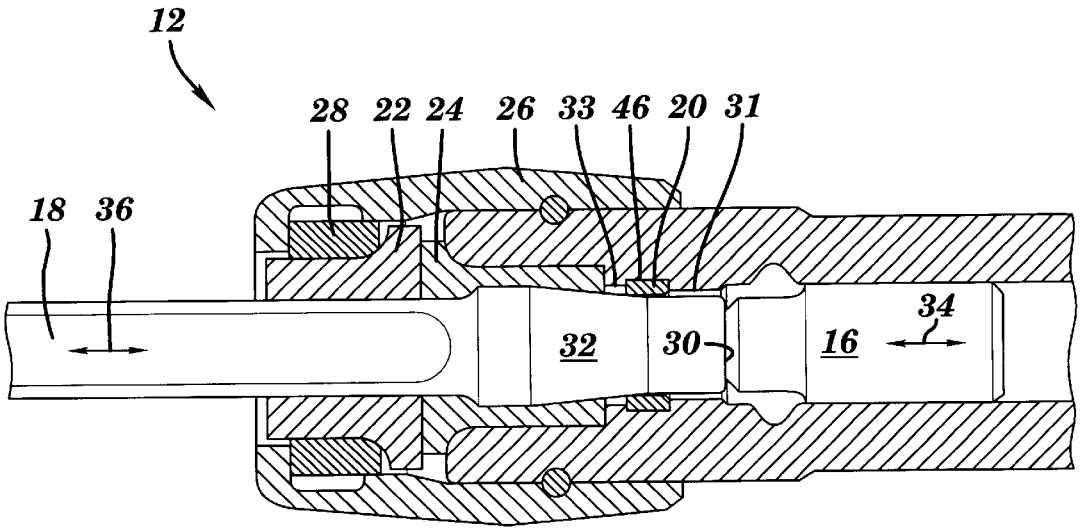
FIG. 2 depicts a cross-sectional side view of the lower barrel portion of a pneumatic tool with a workpiece in a neutral position in accordance with the present invention.
Figure 3:
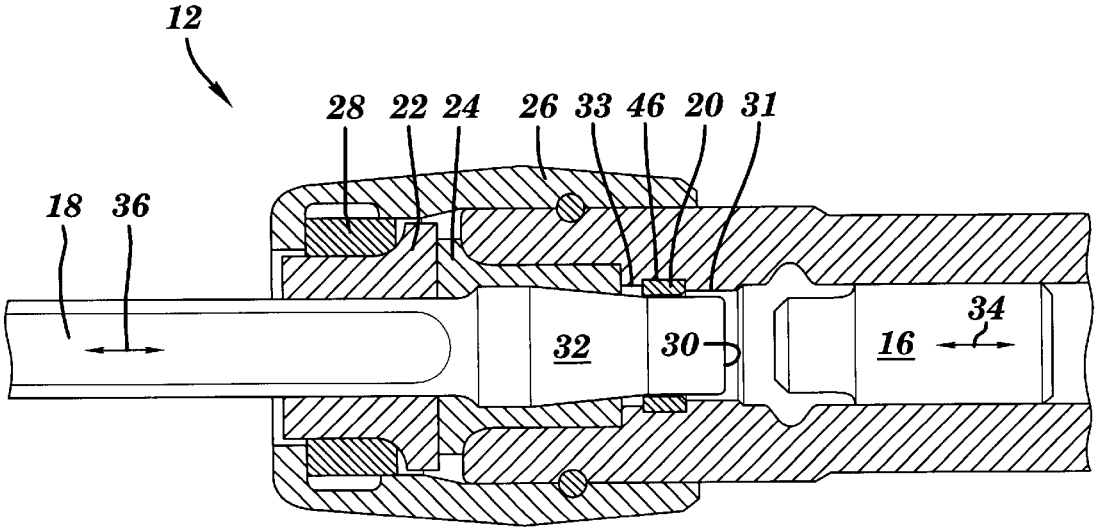
FIG. 3 depicts a cross-sectional side view of the lower barrel portion of a pneumatic tool with a workpiece in an extended position in accordance with the present invention.

FIGS. 2 and 3 depict the placement of the retainer ring 20 during operation of the tool 10. The retainer ring 20 is placeable in a groove 46 cut out of the inside of the distal portion 12 of the barrel 17. It can be seen in both FIG. 2 and FIG. 3 that the retainer ring 20 is mounted in such a position that it is circumferentially outside (i.e., distally spaced from) the cross-sectional area of the butt portion 32 of the workpiece 18. The butt 32, as used herein, defines that portion of the workpiece 18 that reciprocates within or through the retainer ring 20 during operation of the tool 10.

FIG. 2 depicts the workpiece 18 in a retracted or "neutral" position such that the workpiece 18 is retracted into the distal portion 12 of the barrel 17 as far as possible. As can be seen, the first inner sleeve 24 is flush with the end of the barrel 17 thereby limiting the inward travel of the workpiece 18 to the point shown. Conversely, FIG. 3 depicts the workpiece 18 in an extended or "impact" position such that the workpiece 18 is extended out of the barrel 17 as far as possible. As illustrated, the second inner sleeve 22 is prevented from further outward motion by the outer sleeve 25 of the retainer sleeve 26. The bumper 28 provides a spring means for returning the workpiece 18 to the retracted position shown in FIG. 2.

During operation, the piston 16 reciprocates along a longitudinal axis 34 and repeatedly strikes the end 30 of the workpiece 18 to drive the workpiece 18 from a retracted position, shown in FIG. 2, to an extended position, shown in FIG. 3. The result is a continuous reciprocating motion of the workpiece 18 back and forth along the longitudinal axis 36.

The motion of the piston 16 is limited in the direction toward the workpiece 18 by the end 30 of the workpiece 18 in the extended position as shown in FIG. 2. Furthermore, because the stepped lower end 15 of the piston 16 has a diameter less than the diameter of the opening 42 in the retainer ring 20 (see FIG. 6), the retainer ring 20 does not interfere with the motion of the piston 16 while the tool 10 is operating.

Similarly, the butt 32 of the workpiece 18 reciprocates within the opening 42 of the retainer ring 20. Therefore, the butt 32 does not contact the retainer ring 20 during operation of the tool 10 because the retainer ring opening 42 (see FIG. 6) has a diameter that is greater than the maximum cross-sectional diameter of the butt 32 of the workpiece 18. Thus, the retainer ring 20 does not interfere with the functional operation of either the piston 16 or the workpiece 18 during the actual operation of the tool 10.

Figure 4:
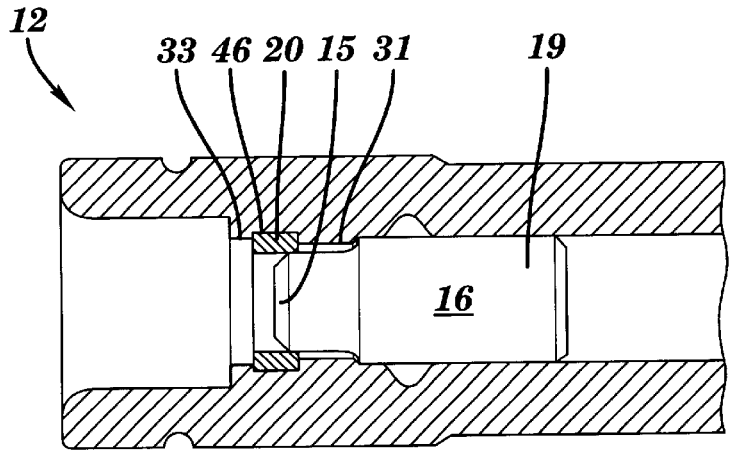
FIG. 4 depicts a cross-sectional side view of a lower barrel portion of a pneumatic tool with the retaining sleeve and workpiece removed, the view depicting the piston being blocked by the first piston retaining mechanism in accordance with the present invention.

The functional purpose of retainer ring 20 is depicted in FIG. 4, which depicts the distal portion 12 of the barrel 17 with the retaining sleeve 26 and the workpiece 18 removed therefrom. As noted above, the retaining sleeve 26 may frequently be removed on a job site to perform maintenance on, to remove or replace the workpiece 18. If the tool 10 happened to be connected to an air supply while the sleeve 26 was removed, pressing the trigger would cause the piston 16 to be forced outward without being limited in its outward travel by the end 30 of the workpiece 18. In this case, the pneumatic force on the piston 16 would cause the piston 16 to be forced toward the opening in the distal portion 12 of the barrel 17. However, the retainer ring 20, which has an opening 42 with a diameter that is less than the maximum diameter of the piston 16, will act to block the free escape of the piston 16 from the distal portion 12 of the barrel 17.

It should be noted that upon impact of the piston 16 with the ring 20, the ring 20 will maintain its relative position in the barrel 17. In particular, the ring 20 will be jammed circumferentially outward into the groove 46 in the distal portion 12 of the barrel 17, thereby ensuring that the piston 16 is trapped in position. Therefore, because the ring 20 expands into the groove 46 in the distal portion 12 of the barrel 17, there is no chance for the ring 20 to be dislodged and pushed out ahead of the piston 16. The expansion of the ring 20 is facilitated by including a ring profile, such as a taper, that causes the ring to expand (see FIGS. 5 and 6).

Figure 5:
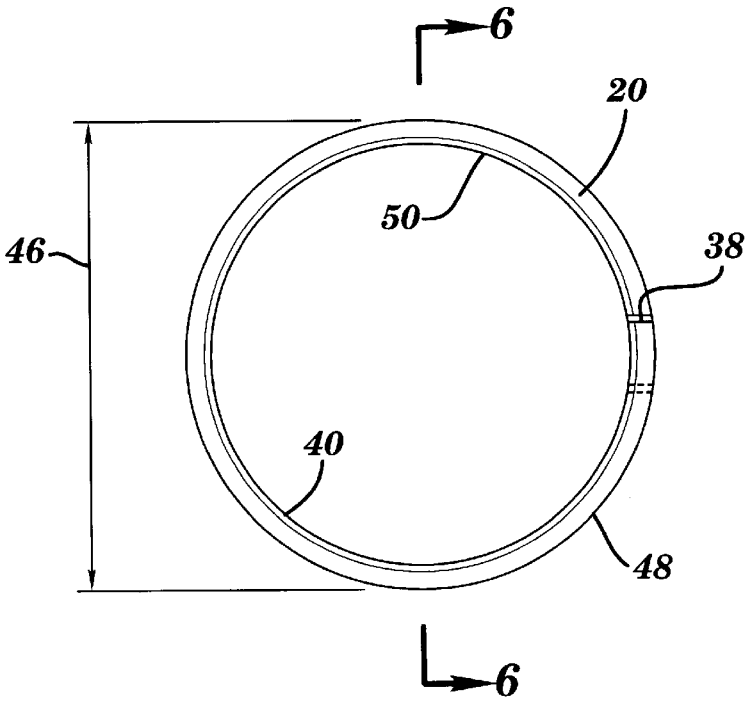
FIG. 5 depicts a front view of the first piston retaining mechanism in accordance with the present invention.
Figure 6:
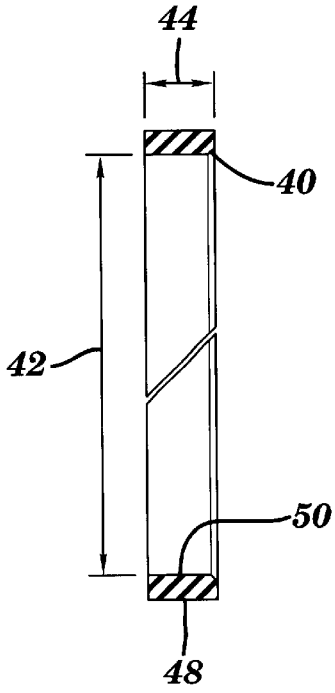
FIG. 6 depicts a cross-sectional side view of the first piston retaining mechanism in accordance with the present invention.

FIGS. 5 and 6 depict a front view and cross-sectional side view of the retainer ring 20, respectively. The retainer ring 20 includes an outer radial surface 48 and an inner radial surface 50. The retainer ring 20 has a minimum opening 42 that is greater in diameter than the butt 32 of the workpiece 18 and the lower end 15 of the piston 16, but smaller in diameter than the maximum diameter of the piston 16, namely at the upper end 19 of the piston 16. The ring 20 has a width 44 and outer diameter 46, which together define the cylindrical cross sectional area or space of the ring 20.

The opening 42 of the ring 20 may include a tapered edge 40 to better handle the impact of the piston 16, should the piston 16 be caused to contact the ring 20. The tapered edge 40 will cause a wedging effect which will cause the ring 20 to be jammed into groove 46 and the piston 16 to become trapped in the barrel 17, rather than bounce back and forth within the barrel 17. It should be recognized that alternate ring profiles, other than a taper, could likewise be utilized to provide a similar result. For example, a concave or rounded profile could possibly provide the same functionality.

The ring 20 may also include a scarf cut 38 which allows the ring 20 to be easily removed or inserted into the barrel 17 of the tool 10. Because of the likely damage caused during an impact of the piston 16 with the ring 20, it is envisioned that the ring 20 should be easily replaceable. In addition, removal of the ring 20 should be relatively easy in the event access to the piston 16, for maintenance purposes or the like, is required.

The ring 20 may be manufactured from a strong, flexible material such as synthetic rubber, plastic, fibre or polyurethane, that is also extremely rugged and hard to shear, such as Dupont's Hytrel 55D™ or Tristar UC200™. Recent advances in the ability to manufacture polyurethane to very specific and demanding specifications, however, may provide unexpectedly good characteristics in terms of strength and durability for this type of retaining device. Nonetheless, other ring materials and designs could provide adequate functionality and are therefore considered to fall within the scope of this invention. For example, a metal snap-ring or spring like device could be substituted for the ring as described herein.

The second piston retaining mechanism 31, in this example a restricted area or neck, is located within the distal portion 12 of the barrel 17. As illustrated more clearly in FIG. 7, the restricted area 31 prevents the piston 16 from escaping the end of the barrel 17 when the retaining sleeve 26 and the workpiece 18 are removed, and the retainer ring 20 is either removed, worn or in some other manner fails to stop the piston 16 from advancing. The restricted area 31 of the barrel 17 has a diameter greater than the diameter of the lower end 15 of the piston 16, but a smaller diameter than the diameter of the upper end 19 of the piston 16. Accordingly, if the retainer ring 20 fails to prevent to escape of the piston 16, the restricted area 31 of the barrel 17 will compensate and stop the forward movement and escape of the piston 16.

The restricted area 31 may be formed within the distal portion 12 of the barrel 17 using a conventional machining process, or other similarly used processes.

Figure 7:
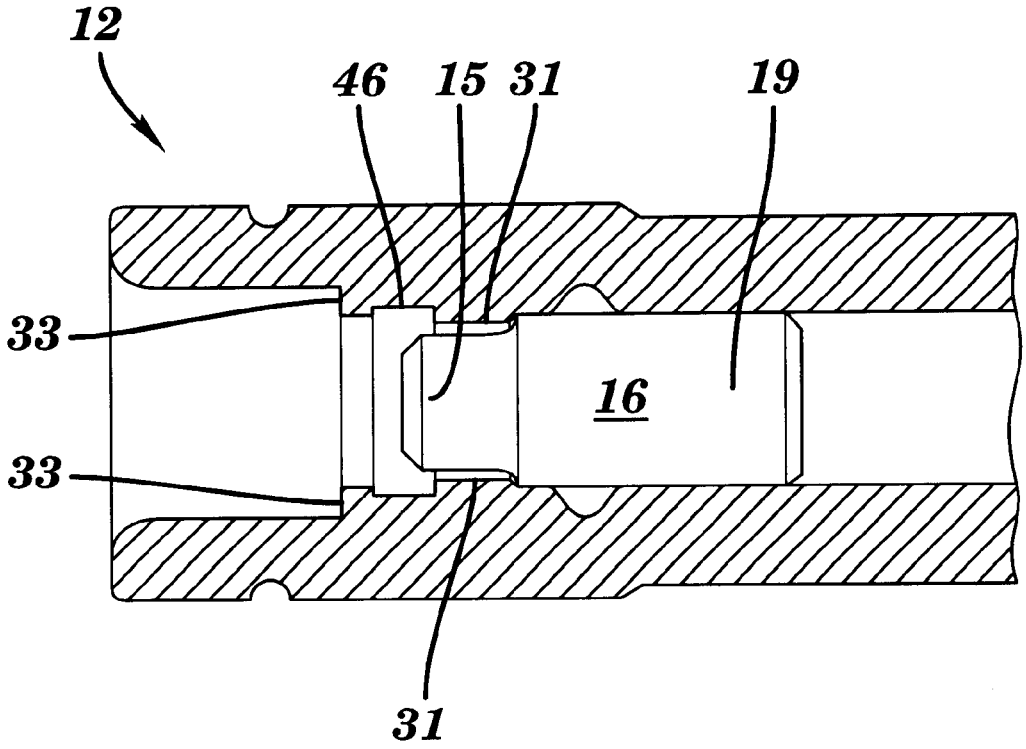
FIG. 7 depicts a cross-sectional side view of a lower barrel portion of a pneumatic tool with the retaining sleeve and workpiece removed, the view depicting the piston being blocked by the second piston retaining mechanism in accordance with the present invention.

The third piston retaining mechanism 33, in this example an annular ring, is formed within the distal portion 12 of the barrel 17 beyond the location of the restricted area 31, as illustrated in FIG. 7. The annular ring 33 acts an additional safeguard to prevent the piston 16 from exiting the end of the barrel 17 when the restricted area 31 is damaged in such a manner that it fails to prevent the advancement and escape of the piston 16.

The annular ring 33 may be formed during manufacture of the barrel using a conventional machining process, or other similarly used processes. Alternatively, the restricted area 31 may be formed outside the tool 10 and mounted within the distal portion 12 of the barrel 17 using known attachment methods, such as welding, etc.

The embodiments and examples set forth herein were presented in order to best explain the present invention and its practical application and to thereby enable those skilled in the art to make and use the invention. However, those skilled in the art will recognize that the foregoing descriptions and examples have been presented for the purposes of illustration and example only. The description as set forth is not intended to be exhaustive or to limit the invention to the precise form disclosed. Many modifications and variations are possible in light of the above teaching without departing from the spirit and scope of the following claims.

I claim:

1. A pneumatic tool comprising:

a barrel;

a workpiece, slidably retained in the barrel;

a piston, slidably mounted within the barrel for engaging the workpiece; and a piston retaining system located within the barrel, wherein the retaining system is configured for allowing a portion of the piston to extend therethrough to engage the workpiece while retaining the piston, further wherein the piston retaining system comprises:
a piston retainer ring;
a restricted area; and
an annular ring.

2. The pneumatic tool of claim 1, wherein the retainer ring is mounted within the barrel distally around a butt of the workpiece proximate the first end of the workpiece, and wherein the butt can reciprocate within and independently of the retainer ring.

3. The pneumatic tool of claim 1, wherein the piston has a range of reciprocating motion that intersects the cylindrical space defined by the retainer ring.

4. The pneumatic tool of claim 1, wherein the piston has a limited range of motion that prevents the piston from contacting the retainer ring, the limited range of motion being limited by the workpiece.

5. The pneumatic tool of claim 1, wherein the retainer ring has an inner surface that is tapered to cause a wedging effect to trap the piston in the barrel should the second portion of the piston contact the retainer ring.

6. The pneumatic tool of claim 1, wherein the retainer ring includes a scarf cut.

7. The pneumatic tool of claim 1, wherein the barrel includes a circular groove within the lower portion of the barrel for holding the retainer ring.

8. The pneumatic tool of claim 1, wherein the retainer ring is comprised of a synthetic rubber.

9. The pneumatic tool of claim 1, wherein the retainer ring is comprised of plastic.

10. The pneumatic tool of claim 1, wherein the retainer ring is comprised of fibre.

11. The pneumatic tool of claim 1, wherein the retainer ring is removably mounted within the barrel.

12. The pneumatic tool of claim 1, wherein the retainer ring further includes an opening having a diameter that is greater than the diameter of a first end of the workpiece and a first portion of the piston, but less than the diameter of a second portion of the piston.

13. The pneumatic tool of claim 1, wherein the restricted area has a diameter greater than the diameter of a first end of the workpiece.

14. The pneumatic tool of claim 1, wherein the restricted area has a diameter less than the diameter of a second portion of the piston.

15. The pneumatic tool of claim 1, wherein the annular ring is located in a distal portion of the barrel beyond the a location of the restricted area.

16. The pneumatic tool of claim 1, wherein the annular ring has a diameter greater than the diameter of a first end of the workpiece.

17. The pneumatic tool of claim 1, wherein the annular ring has a diameter less than the diameter of a second portion of the piston.

18. The pneumatic tool of claim 1, wherein a first portion of the piston comprises a stepped end.

19. A reciprocating tool comprising:

a barrel;

a piston slidably placed within the barrel;

a retaining sleeve mounted on the barrel;

a workpiece slidably retained within the barrel by the retaining sleeve; and a first piston retaining mechanism and a second piston retaining mechanism for preventing the free escape of the piston from the barrel when the retaining sleeve and workpiece are removed from the tool, such that neither the piston nor the workpiece contact the first and second piston retainer mechanisms during operation of the tool.

20. The reciprocating tool of claim 19, further comprising a third piston retaining mechanism for preventing the free escape of the piston from the barrel when the retaining sleeve and workpiece are removed from the tool, and the first and second retaining mechanisms fail, such that neither the piston nor the workpiece contact the third piston retainer mechanism during operation of the tool.

21. The reciprocating tool of claim 20, wherein the third piston retaining mechanism comprises an annular ring.

22. The reciprocating tool of claim 20, wherein the first end of the piston has a diameter less than the diameter of the third piston retaining mechanism.

23. The reciprocating tool of claim 20, wherein the second end of the piston has a diameter greater than the diameter of the third piston retaining mechanism.

24. The reciprocating tool of claim 19, wherein the first piston retaining mechanism comprises a retainer ring.

25. The reciprocating tool of claim 24, wherein the retainer ring is comprised of synthetic rubber.

26. The reciprocating tool of claim 24, wherein the retainer ring includes a cylindrical opening that is tapered.

27. The reciprocating tool of claim 24, wherein the retainer ring includes a scarf cut to facilitate removal.

28. The reciprocating tool of claim 19, wherein the second piston retaining mechanism comprises a restricted area within a lower portion of the barrel.

29. The reciprocating tool of claim 19, wherein the piston further includes a first end having a first diameter and a second end having a second diameter, wherein the first diameter is less than the second diameter.

30. The reciprocating tool of claim 29, wherein the first end of the piston has a diameter less than the diameter of the first and second piston retaining mechanisms.

31. The reciprocating tool of claim 29, wherein the second end of the piston has a diameter greater than the diameter of the first and second piston retaining mechanisms.

32. An improved reciprocating tool of the type having a barrel with a piston that strikes a first end of a workpiece being held in place by a retaining sleeve, the improvement comprising a first piston retaining mechanism, a second piston retaining mechanism, and a third piston retaining mechanism.

33. The improvement of claim 32, wherein both the piston and workpiece reciprocate distally from the first, second and third piston retaining mechanisms such that the retaining mechanisms are never contacted by the piston or the workpiece while the tool is operating.

34. The improvement of claim 32, wherein the first retaining mechanism is a retainer ring.

35. The improvement of claim 34, wherein the retainer ring includes an opening with a diameter greater than the maximum diameter of the end of the workpiece.

36. The improvement of claim 34, wherein the retainer ring includes a tapered opening.

37. The improvement of claim 34, wherein the retainer ring includes a scarf cut.

38. The improvement of claim 32, wherein the second retaining mechanism is a restricted area within a lower portion of the barrel.

39. The improvement of claim 38, wherein the restricted area has a diameter greater than the maximum diameter of the end of the workpiece.

40. The improvement of claim 38, wherein the restricted area has a diameter less than the maximum diameter of the piston.

41. The improvement of claim 32, wherein the third piston retaining mechanism comprises an annular ring within a lower portion of the barrel beyond the second piston retaining mechanism.

42. The improvement of claim 41, wherein the annular ring has a diameter greater than the maximum diameter of the end of the workpiece.

43. The improvement of claim 41, wherein the annular ring has a diameter less than the maximum diameter of the piston.

44. A reciprocating tool comprising:

a barrel;

a piston slidably placed within the barrel;

a retaining sleeve mounted on the barrel;

a workpiece slidably retained within the barrel by the retaining sleeve; and a piston retaining mechanism for preventing the free escape of the piston from the barrel when the retaining sleeve and workpiece are removed from the tool, such that neither the piston nor the workpiece contact the piston retaining mechanism during operation of the tool.

45. The reciprocating tool of claim 44, wherein the piston retaining mechanism comprises:

a retainer ring within a lower portion of the barrel;

a restricted area of the barrel located within the barrel beyond the retainer ring; and an annular ring located within the barrel beyond the restricted area.

* * * * *